US005771613A

United States Patent [19]

Geils et al.

[11] Patent Number: 5,771,613

[45] Date of Patent: Jun. 30, 1998

[54] EMBROIDERY EASEL APPARATUS

[76] Inventors: Neal Geils, 2338 Kipland Dr., Santa Rosa, Calif. 95401; Victoria Meyer, 1657 Finlaw, Santa Rosa, Calif. 95404

[21] Appl. No.: 947,512

[22] Filed: Oct. 10, 1997

[51] Int. Cl.[6] ..... D06C 3/08; A47C 29/00

[52] U.S. Cl. ..... 38/102.21; 38/102.4; 38/102.1; 108/150; 108/176; 248/246.01

[58] Field of Search ..... 38/102.1, 102.21, 38/102.4, 102.9, 102.91; 108/176, 150, 1, 3, 4, 6, 7, 9, 155, 154, 158, 160, 153, 115; 248/664, 163.1, 440, 440.1, 188.8, 188.9, 188.91, 346.01, 346.03, 346.05, 346.07; 160/371, 372, 377, 378

[56] References Cited

U.S. PATENT DOCUMENTS

| | | | |
|---|---|---|---|
| 800,951 | 9/1905 | Payen | 38/102.4 |
| 1,782,313 | 11/1930 | Poehls | 248/346.07 |
| 2,499,668 | 3/1950 | Morgan et al. | 108/155 |
| 3,098,280 | 7/1963 | Harris et al. | 38/102.91 X |
| 3,899,164 | 8/1975 | Newman | 269/71 |
| 3,938,267 | 2/1976 | Bard | 38/102 |
| 3,955,722 | 5/1976 | Bard | 223/106 |
| 4,175,343 | 11/1979 | Mathews | 38/102.1 |
| 5,027,989 | 7/1991 | Nevius | 38/102.4 X |
| 5,357,690 | 10/1994 | Padawer | 38/102 |
| 5,680,943 | 10/1997 | Robley | 248/163.1 X |

OTHER PUBLICATIONS

Brochure of Tomorrow's Treasures showing embroidery easels and frames. 4 sheets.

Brochure of Artisan Design showing embroidery easels and frames. 4 sheets.

Assembly instructions for Legend Floor Model Frame Holder by Gripit Plus. 4 sheets.

Pp. 102 of *Victorian Needlepoint* by Beth Russell, 1991, showing scrolling embroidery frame (travel frame) with stapled anchoring strips.

Assembly instructions sheet of K's Creations, Austin, TX, showing a scrolling embroidery frame.

Assembly instructions sheet of Gripit Plus, Albuquerque, NM, showing an embroidery easel.

*Primary Examiner*—Ismael Izaguirre
*Attorney, Agent, or Firm*—Jack Lo

[57] ABSTRACT

An embroidery easel apparatus includes a base, an adjustable arm with a lower end attached to the base, a rotatable head attached to an upper end of the arm, a clamp attached to the head, and a scrolling embroidery frame held in the clamp. The frame includes a pair of spaced rollers and a crossbar extending between side members. The clamp grips the frame by the crossbar, so that the rollers can be rotated for advancing a work piece mounted therebetween, and so that the work piece is not damaged by the clamp. The frame can be rotated or flipped over to allow access to the underside of the work piece. In a second embodiment, the clamp is rotatably attached to the upper end of the arm. The rotational axis of the clamp is positioned along the plane of the frame, so that the height of the frame is not changed after it is flipped over.

9 Claims, 4 Drawing Sheets

EMBROIDERY EASEL APPARATUS

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates generally to stitchery equipment, specifically to an embroidery easel with a rotatable head.

2. Prior Art

Embroidery is the art of embellishing fabric with stitched designs. It is typically performed by stretching taut a piece of fabric or work piece within a frame, and stitching on designs by passing a needle and colored threads through the work piece. For small designs, a hoop frame is used for stretching a small area of the work piece. For larger designs, a scroll frame is used to scroll a long work piece as the design progresses.

A typical scroll frame, also known as a travel frame, is shown on page 102 of the book Victorian Needlepoint. It includes two rollers rotatably mounted between opposite side members. A fabric anchoring strip is stapled to each roller. A long rectangular work piece is mounted onto the frame by stitching each end of the work piece to a corresponding anchoring strip, and rolling the work piece around one roller until it is stretched taut between the rollers. As the embroidery design progresses, the work piece is gradually scrolled from one roller to the other. However, the staples may snag and damage the work piece. Furthermore, the fabric anchoring strips tend to tear and come apart from the staples after repeated use.

During embroidering, the needle must be passed through the bottom of the work piece, so that the frame cannot be placed on a table. Although small frames can be held with one hand while stitching is performed by the other hand, larger and heavier frames are usually held on a stand or easel. During the embroidering process, the frame must be turned over frequently to allow work to be performed on the underside of the work piece.

An easel sold under the trademark "GRIPIT" by Gripit Plus, Inc. of Albuquerque, N. Mex., includes a base, an adjustable arm attached to the base, and a rotatable clamp assembly for gripping an embroidery frame. A wooden dowel extending from the clamp assembly is gripped in a swivel attached to one side of the arm. The axis of the dowel is thus offset from the longitudinal centerline of the arm. When the dowel is fully inserted into the swivel, a portion of the dowel remains outside of the swivel, so that it is subject to bending stresses caused by the weight of the frame and the user pressing on the frame, which would eventually cause the dowel to break. Besides being structurally weak, the dowel squeaks annoyingly when the clamp is turned about the swivel. Although the "GRIPIT" easel can hold a scroll frame, the clamp assembly must clamp onto one of the frame's rollers, which prevents the work piece from being scrolled, and may also damage it.

Gripit Plus, Inc. also sells another easel under the trademark "LEGEND FLOOR MODEL FRAME HOLDER." It includes a U-shaped frame attached to the end of an arm on a stand. The U-shaped frame is pivotable about a vertical axis. A scroll frame is held in the U-shaped frame by a pair of pivoting clamps at the ends of the "U", so that the scroll frame is rotatable about a transverse horizontal axis. The attachment between the arm and the U-shaped frame is weak and prone to failure. The transverse rotational axis of the scroll frame causes backside of the embroidery pattern to be oriented upside-down after the frame is rotated, which tends to be confusing.

Easels sold under the trademarks "GAZELLE" and "ELAN" by Artisan Design of Broken Arrow, Okla., include clamps pivotally attached to the end of an arm on a stand. The clamps are rotatable about a transverse horizontal axis, so that flipping over the frame causes the backside of the embroidery pattern to be oriented upside-down.

An easel sold by Tomorrow's Treasures of Woodinville, Wash., includes a clamp attached to the end of an arm on a stand. The clamp is rotatable about a longitudinal horizontal axis. The clamp is substantially offset relative to its longitudinal horizontal rotational axis. After the scroll frame is flipped over, its height is substantially changed, so that a user must readjust the positioning of the arm to restore the height of the frame.

A scroll frame sold by K's Creations of Austin, Tex., is pivotally mounted on a small stand that allows it to be flipped over about a transverse axis. However, the stand must be placed on a table, which limits the options in positioning the frame. Furthermore, flipping over the frame causes the backside of the embroidery pattern to be oriented upside down.

OBJECTS OF THE INVENTION

Accordingly, an object of the present invention is to provide an improved embroidery easel apparatus that is durable.

Another object of the present invention is to provide an embroidery easel apparatus that is highly adjustable for positioning a scroll frame at different heights.

Another object of the present invention is to provide an embroidery easel apparatus that can flip over the scroll frame for allowing easy access to the underside of the work piece.

Another object of the present invention is to provide an embroidery easel apparatus that can flip over the scroll frame about a longitudinal horizontal axis, so as to maintain the backside of the embroidery pattern in an upright position.

Another object of the present invention is to provide an embroidery easel apparatus that can flip over the scroll frame without altering its height.

Yet another object of the present invention is to provide an embroidery easel apparatus that does not damage the work piece.

Other objects of the present invention will become apparent from a consideration of the drawings and ensuing description.

BRIEF SUMMARY OF THE INVENTION

An embroidery easel apparatus includes a base, an adjustable arm with hinged sections, and a rotatable head attached to the upper end of the arm. A clamp attached to the head holds a scrolling embroidery frame. The clamp includes a pair of knobs with shafts extending through upper and lower horizontal members, and a thumb screw also extending through the upper and lower horizontal members. The embroidery frame includes two rollers and a cross bar mounted transversely between opposite side members. The clamp of the easel is clamped onto the cross bar, so that the rollers are free to rotate, and so that the work piece is not damaged by the clamp. The clamp is rotatable about a longitudinal axis, so that the backside of the embroidery pattern is kept upright after the frame is flipped over.

In a second embodiment, the clamp is rotatably attached to the upper end of the adjustable arm by an axle. Springs are positioned around the shafts of the knobs, and between the upper and lower horizontal members of the clamp for urging them apart. The axle is positioned between the upper and lower members of the clamp, so that the height of the embroidery frame is not changed after it is flipped over.

DRAWING REFERENCE NUMERALS

| | |
|---|---|
| 10. Base | 11. Legs |
| 12. Adjustable Arm | 13. Stationary Arm Section |
| 14. Hinged Arm Section | 15. Hinged Arm Section |
| 16. Hinged U-Shaped Top Section | 17. Knobs |
| 18. Connecting Member | 19. Flat Portion |
| 20. Rotatable Head | 21. Clamp |
| 22. Embroidery Frame | 23. Upper Horizontal Member |
| 24. Lower Horizontal Member | 25. Crossbar |
| 26. Side Members | 27. Rollers |
| 28. Work Piece | 29. Knobs |
| 30. Mounting Holes | 31. Sides |
| 32. End Portion | 33. Rod |
| 34. Cylindrical Member | 35. Bolt |
| 36. Thumb Screw | 37. Arm |
| 38. Hinged Top Section | 39. Sides |
| 40. Connecting Member | 41. Coiled Spring |
| 42. Rotatable Member | 43. Axle |
| 44. Washer | 45. Pin |
| 46. Hole | 47. Chain |
| 48. Cutouts | |

DETAILED DESCRIPTION OF THE INVENTION

Figure 1:
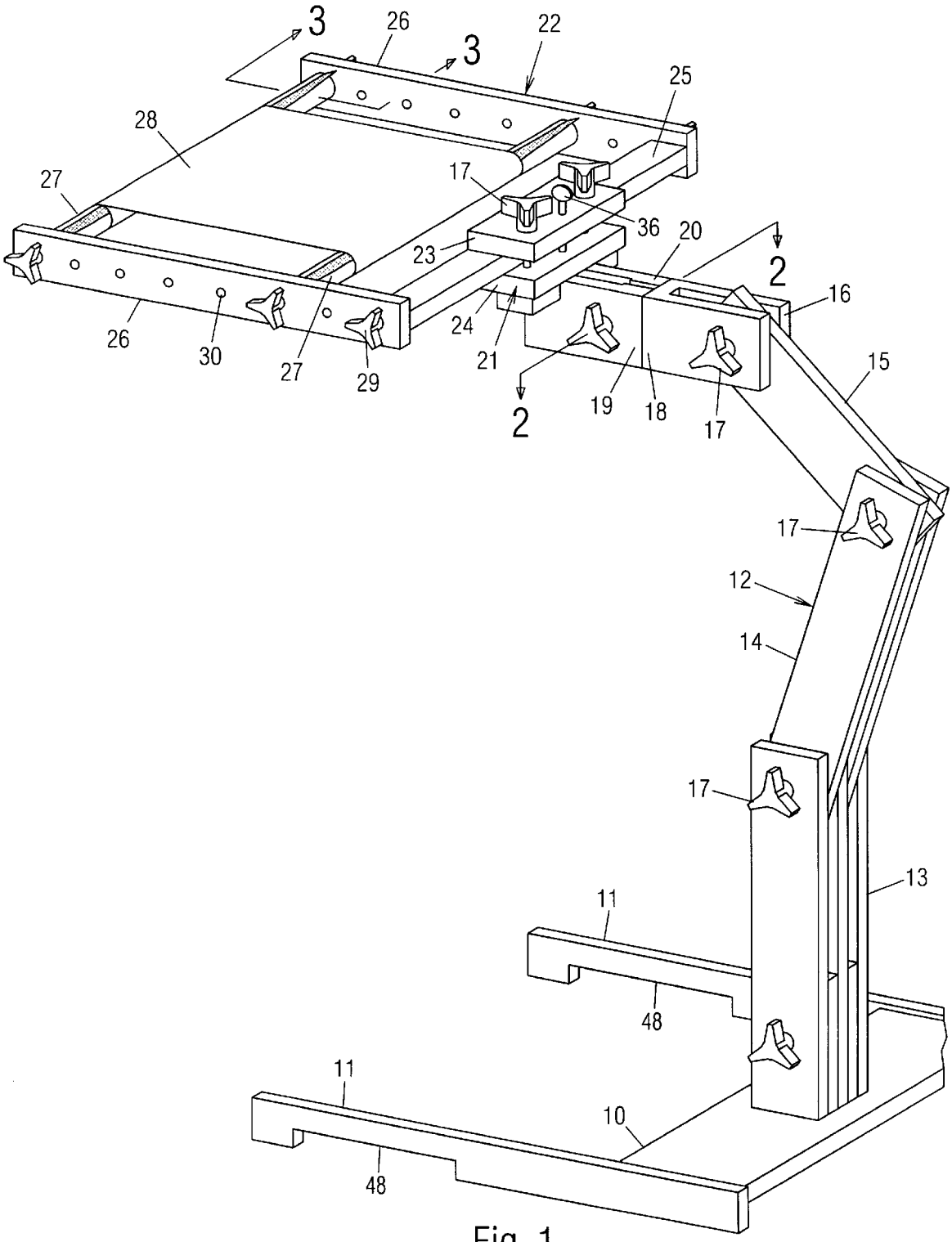
FIG. 1 is a side perspective view of an embroidery easel apparatus in accordance with a first embodiment of the present invention.

FIG. 1:

In accordance with a first embodiment of the invention shown in FIG. 1, an embroidery easel apparatus includes a base 10 with a pair of legs 11 and an adjustable arm 12. Arm 12 includes a stationary arm section 13, a hinged arm section 14, a hinged arm section 15, and an U-shaped top section 16 all hinged and tightened by knobs 17. Arm 12 is adjustable along a vertical plane. The upper end of section 15 is positioned within the "U" of section 16. A flat forward connecting member 18 of section 16 is in butting engagement with a flat portion 19 of a rotatable head 20.

A clamp 21 is attached to head 20 for holding a scrolling embroidery frame 22. Clamp 21 includes upper and lower horizontal members 23 and 24, respectively, which are held together and tightened with a thumb screw 36 and two knobs 17. Thumb screw 36 is slightly offset toward arm 12 relative to knobs 17, so that horizontal members 23 and 24 may be made parallel to each other by adjusting thumb screw 36 relative to knobs 17. Elongated cutouts 48 extend only along the forward halves of legs 11 so as to make their rearward halves heavier. Cutouts 48 thus shift the center of gravity of the easel rearwards, and compensates for the forward positioning of head 20 and frame 22 to increase stability.

Frame 22 includes a crossbar 25 extending between two side members 26, and a pair of rollers 27 for stretching and scrolling a sheet of fabric or work piece 28. Rollers 27 are tightened by small knobs 29, which include threaded shafts (not shown) extending through sides 26 and into rollers 27. Sides 26 each includes a series of spaced mounting holes 30 for allowing rollers 27 to be mounted at different distances from each other for accommodating embroidery designs of different sizes.

To use, base 10 is placed on the ground, and arm 12 is adjusted to position frame 22 within easy reach of a user. Clamp 21 is clamped onto crossbar 25, so that rollers 27 can be rotated for scrolling work piece 28 as the embroidery design (not shown) progresses, and so that work piece 28 would not be damaged.

Figure 2:
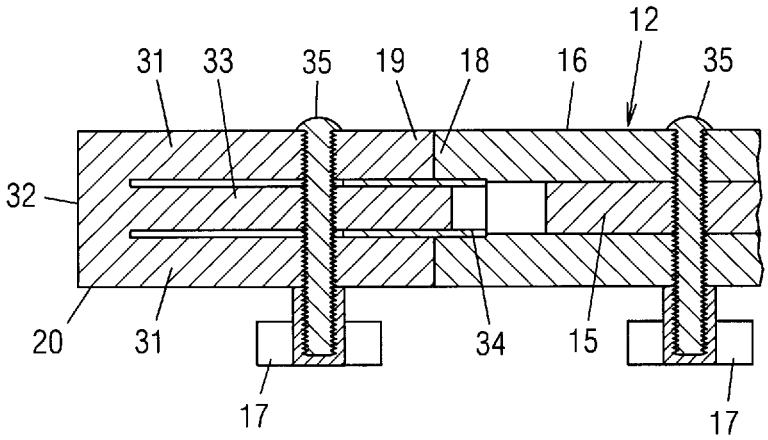
FIG. 2 is a top sectional view of a rotatable head of the embroidery easel apparatus, taken along line 2—2 in FIG. 1.

FIG. 2:

As shown in the top sectional view in FIG. 2, rotatable head 20 includes two sides 31 connected by an end portion 32, and a rod 33 extending therebetween. A metal tube or cylindrical member 34 has one end fixedly attached to connecting member 18 of U-shaped top section 16, and another end frictionally gripped between sides 31 of head 20. Rod 33 is coaxially positioned within cylindrical member 34. Sides 31 are tightened around cylindrical member 34 by a knob 17 and a bolt 35, which is extended through sides 31 and rod 33. Rod 33 and cylindrical member 34 are coaxially positioned along the centerline of arm 12.

When knob 17 on head 20 is loosened, head 20 is rotatable about cylindrical member 34, and when knob 17 is tightened, head 20 is locked in a selected position. Flat portion 19 of head 20 and connecting member 18 of section 16 are in butting engagement to prevent bending stresses from being applied to cylindrical member 34, so that the durability of the easel is greatly improved.

Figure 3:
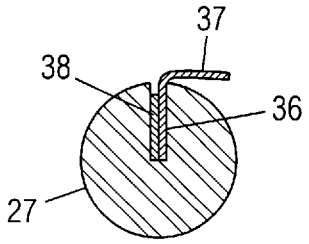
FIG. 3 is a side sectional view of a roller of the embroidery easel apparatus, taken along line 3—3 in FIG. 1.
Figure 4:
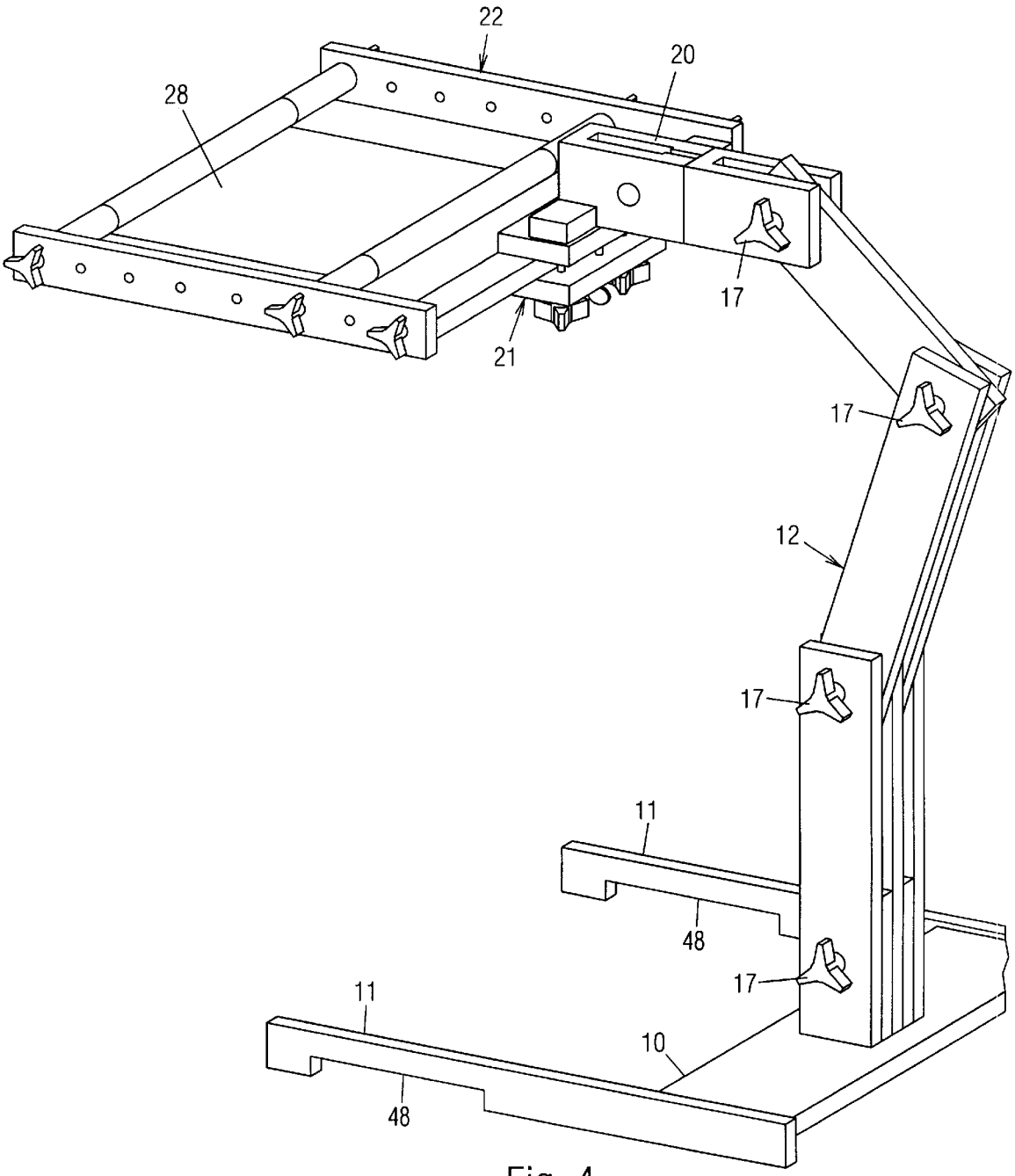
FIG. 4 is a side perspective view of the embroidery easel apparatus, after the head assembly is rotated 180 degrees.

FIG. 3:

As shown in the side sectional view in FIG. 3, each roller 27 includes a longitudinal slot 36 partially receiving a fabric anchor strip 37, to which a corresponding end of work piece 28 (FIG. 1) is temporarily sewn. Anchor strip 37 is secured by a flat strip 38 wedged within slot 36, so that strip 37 will not tear or come loose even after repeated use.

FIG. 4:

Head 20, clamp 21, and frame 22 are rotatable 360 degrees in either direction. They are shown rotated 180 degrees to allow access to the underside of work piece 28. Because frame 22 is rotatable about a longitudinal axis which is aligned with the centerline of arm 12, the embroidery pattern (not shown) is maintain in an upright position after it is flipped over, i.e., the right and left sides of the pattern are reversed, but the top and bottom are not.

Figure 5:
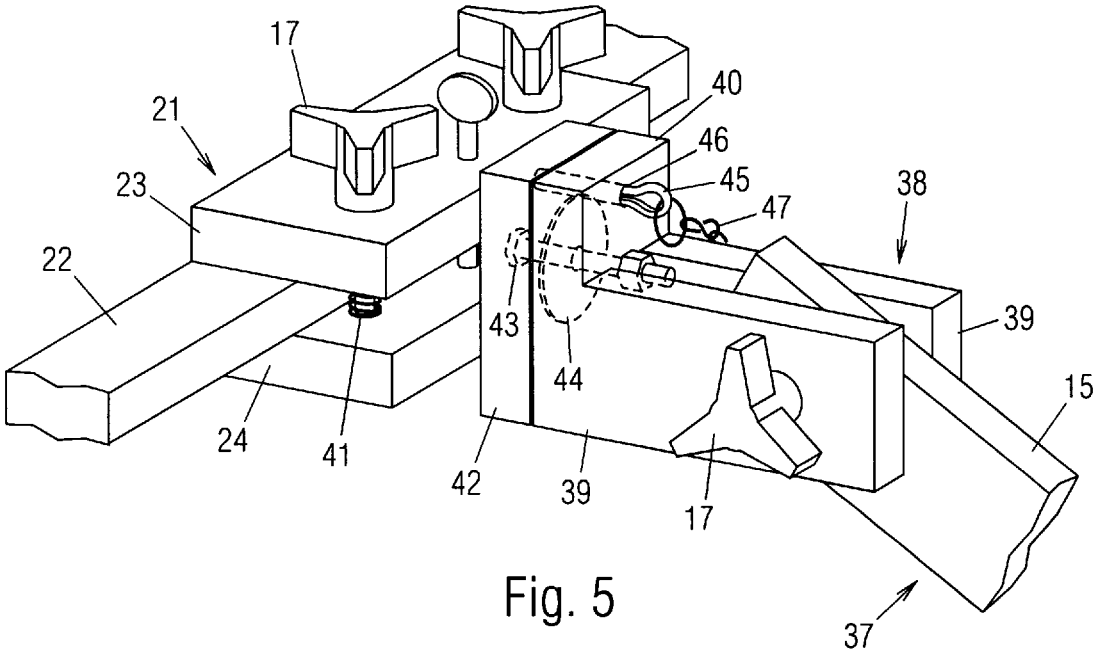
FIG. 5 is a side perspective view of an embroidery easel apparatus in accordance with a second embodiment of the present invention.

FIG. 5:

In accordance with a second embodiment of the invention shown in FIG. 5, an embroidery easel apparatus includes the same base 10 (FIG. 1) and an adjustable arm 37 substantially similar to arm 12 (FIG. 1). The only difference being a hinged top section 38, which includes opposite sides 39 positioned on either side of hinged arm section 15, and a flat forward connecting member 40 attached between the ends of sides 39. The top end of connecting member 40 is extended above the top edges of sides 39.

A flat rotatable member 42 is rotatably attached to connecting member 40 by a bolt or axle 43. A large diameter washer 44 is positioned between rotatable member 42 and connecting member 40. Fixed horizontal lower member 24 of clamp 21 is fixedly attached to the forward side of rotatable member 42. Upper horizontal member 23 is movable relative to rotatable member 42. The gap between lower member 24 and upper member 23, and thus embroidery frame 22 are aligned with axle 43. A coil spring 41 is coaxially positioned around the shaft of each knob 17 on clamp 21, between lower member 24 and upper member 23 for urging them apart. A cotter pin 45 is inserted into aligned holes 46 (one shown) on connecting member 40 and rotatable member 42 to lock clamp 21 in position. Pin 45 is connected to a side 39 by a chain 47.

Figure 6:
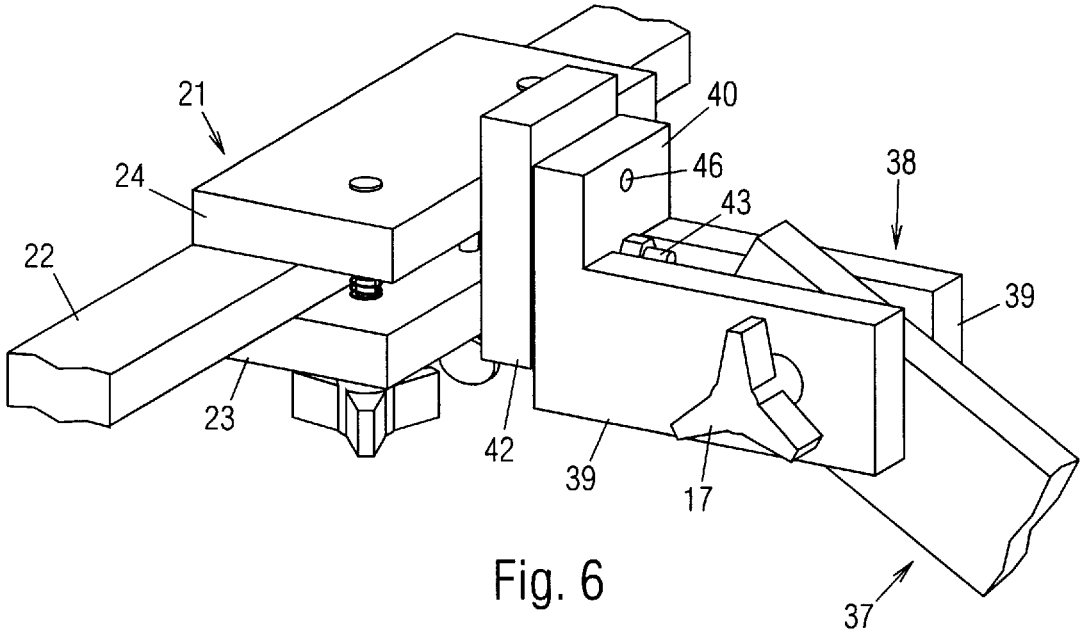
FIG. 6 is a side perspective view of the embroidery easel apparatus of FIG. 5, after the clamp is rotated 180 degrees.

FIG. 6:

Frame 22 can be flipped over to provide access to the underside of the embroidery pattern by removing pin 45 (FIG. 5), and rotating clamp 21 180 degrees, as shown in FIG. 6. Because axle 43 is aligned with the plane of frame 22, the height of frame 22 is not changed after it is rotated. Connecting member 40 and rotatable member 42 are tall enough to prevent bending stresses from being applied to axle 43, so that the durability of the easel is greatly improved.

SUMMARY AND SCOPE

Accordingly, the reader will see that we have provided an improved embroidery easel apparatus that is adjustable for positioning a scrolling frame within easy reach of any user. Its head can be rotated 180 degrees for flipping over the frame, so as to allow easy access to the underside of the work piece. It rotates the frame about a longitudinal axis, so that the underside of the embroidery pattern is maintained in an upright position after the frame is rotated. It maintains the height of the frame after it is flipped over. It holds the frame securely without damaging the work piece, and it is also very durable.

Although the above descriptions are specific, they should not be considered as limitations on the scope of the invention, but only as examples of the preferred embodiment. Many other ramifications and variations are possible within the teachings of the invention. For example, the base can be of other shapes. The arm with adjustable sections can be replaced with a "goose neck" or any other type of adjustable support. The clamp can be used for holding any other type of embroidery frame. Other types of clamps can be used for clamping the frame. Therefore, the scope of the invention should not be determined by the examples given, but by the appended claims and their legal equivalents.

We claim:

1. An easel for holding an embroidery frame, comprising:

a base;

an elongated adjustable arm having a lower end attached to said base, said arm including a U-shaped top section with opposite sides connected by a forward connecting member, an adjacent lower section of said arm being hingeably positioned between said opposite sides of said U-shaped top section;

a hollow cylindrical member extending forwardly from said connecting member of said U-shaped top section, said hollow cylindrical member parallel to said opposite sides of said U-shaped top section;

a rotatable head including two spaced sides positioned around said cylindrical member, said spaced sides abutting said forward connecting member of said U-shaped top section, said rotatable head having an end portion connecting said spaced sides opposite a distal end of said cylindrical member, said rotatable head having a rod extending from said end portion and positioned between said spaced sides, said rod coaxially and rotatably positioned within hollow cylindrical member;

means for tightening said spaced sides around said cylindrical member; and a clamp attached to said head for clamping said embroidery frame.

2. The easel of claim 1, wherein said adjustable arm comprises a plurality of hinged sections.

3. The easel of claim 1, wherein said clamp comprises spaced upper and lower members for being positioned above and below said embroidery frame, and means for tightening said upper and lower members around said frame.

4. An easel for holding an embroidery frame, comprising:

a base;

an elongated adjustable arm having a lower end attached to said base, said arm including a hinged top section with opposite sides connected by a forward connecting member, an adjacent lower section of said arm being hingeably positioned between said opposite sides of hinged top section;

a rotatable member abutting said connecting member of said hinged top section;

an axle extending through said rotatable member and said connecting member of said hinged top section, said axle parallel to said opposite sides of said hinged top section; and a clamp for clamping said embroidery frame, said clamp including a lower horizontal member fixedly attached to a forward side of said rotatable member below an axis of said axle, an upper horizontal member movably positioned above said lower horizontal member and above said axis of said axle, at least two knob means each having a shaft extending vertically through said upper horizontal member and said lower horizontal member, and a spring positioned coaxially around each shaft between said upper horizontal member and said lower horizontal member.

5. The easel of claim 4, further including a pin positioned through said rotatable member and said connecting member of said hinged top section, said pin locking said rotatable member in position, said pin being removable for permitting rotation of said rotatable member and said clamp.

6. The easel of claim 4, further including a washer positioned around said axle between said rotatable member and said connecting member of said hinged top section.

7. The easel of claim 4, further including a thumb screw means extending vertically between said upper horizontal member and said lower horizontal member of said clamp, said thumb screw means positioned between said two knob means.

8. An easel for holding an embroidery frame, comprising:

an elongated adjustable arm;

a clamp attached to an upper end of said arm for holding said embroidery frame;

a horizontal base attached to a lower end of said arm; and a pair of elongated legs extending horizontally from opposite sides of said base, each of said legs including an elongated cutout extending only along a forward half thereof, said cutout shifting a center of gravity of said easel backwards and balancing said easel when said frame is held in said clamp.

9. The embroidery easel apparatus of claim 8, wherein said cutout is positioned along a lower edge of each of said legs.

* * * * *